United States Patent [19]

Kubo

[11] Patent Number: 4,904,557

[45] Date of Patent: Feb. 27, 1990

[54] ELECTROPHOTOGRAPHIC PHOTOSENSITIVE MEMBER HAVING A ROUGHENED SURFACE

[75] Inventor: Keiji Kubo, Tokyo, Japan

[73] Assignee: Canon Kabushiki Kaisha, Tokyo, Japan

[21] Appl. No.: 253,878

[22] Filed: Oct. 5, 1988

Related U.S. Application Data

[63] Continuation of Ser. No. 177,882, Mar. 30, 1988, abandoned, which is a continuation of Ser. No. 1,882, Jan. 9, 1987, abandoned.

[30] Foreign Application Priority Data

Jan. 13, 1986 [JP] Japan ..... 61-003554

[51] Int. Cl.[4] ..... G03G 5/02; G03G 5/14

[52] U.S. Cl. ..... 430/56; 430/58; 430/950; 430/945; 430/64; 355/35; 346/160

[58] Field of Search ..... 430/56, 58, 950, 64; 355/35 H

[56] References Cited

U.S. PATENT DOCUMENTS 4,514,483 4/1985 Matsuura ..... 430/63 X
4,618,552 10/1986 Tanaka et al. ..... 430/58 X

FOREIGN PATENT DOCUMENTS 0085927 1/1983 European Pat. Off. .

*Primary Examiner*—J. David Welsh
*Attorney, Agent, or Firm*—Fitzpatrick, Cella, Harper & Scinto

[57] ABSTRACT

An electrophotographic photosensitive member comprises a photosensitive layer on a conductive substrate having a smooth surface, wherein said photosensitive layer has a surface roughness, represented by an average roughness Rz of ten points over a reference length of 2.5 mm, is equal to or larger than ½ of the wavelength of the light source employed for image formation.

8 Claims, 1 Drawing Sheet

ELECTROPHOTOGRAPHIC PHOTOSENSITIVE MEMBER HAVING A ROUGHENED SURFACE

This application is a continuation of application Ser. No. 177,882, filed Mar. 30, 1988, which, in turn, is a continuation of application Ser. No. 001,882, filed Jan. 9, 1987, both abandoned.

BACKGROUND OF THE INVENTION

1. Field of the Invention

The present invention relates to an electro-photographic photosensitive member, and more particularly such photosensitive member adapted for use in an electro-photographic printer in which a laser beam performs line scanning according to image.

2. Related Background Art

Conventional electrophotographic printers utilizing laser beam scanning employ a gas laser of a relatively short wavelength such as helium-cadmium laser, argon laser or helium-neon laser, in combination with an electrophotographic photosensitive member involving a thick photosensitive layer such as a CdS-binder photosensitive layer or a charge transfer complex as disclosed in the IBM Journal of the Research and Development, Jan. 1971, p. 75–89. Consequently, the laser beam does not cause multiple reflection in the photosensitive layer, so that the formed image is practically free from interference fringe patterns.

However, the above-mentioned gas lasers are recently being replaced by semiconductor lasers for compactization and cost reduction of the apparatus. Since such semiconductor lasers generally have oscillation wavelengths in excess of 750 nm, there have been developed electrophotographic photosensitive members showing a high sensitivity in such long wavelength region.

Certain photosensitive members are already known to be sensitive to the light of a long wavelength region, for example in excess of 600 nm, such as a laminated photosensitive member provided with a photosensitive layer containing a phthalocyanine pigment such as copper-phthalocyanine or aluminum chloride-phthalocyanine, particularly a photosensitive layer of a laminate structure composed of a charge generation layer and a charge transport layer, or a photosensitive member utilizing a selenium-tellurium film.

However, such photosensitive member, sensitive to such long wavelength region, when exposed to a laser beam in an electrophotographic printer utilizing laser beam scanning, is incapable of satisfactory image reproduction due to the interference fringe patterns in the formed toner image.

This drawback is ascribed to the fact that the laser beam of a long wavelength is not completely absorbed in the photosensitive layer but is reflected by the substrate to generate multiple reflected lights which cause interference with the light reflected on the surface of the photosensitive layer.

In order to resolve such drawbacks there has been proposed to grain the surface of a conductive substrate employed in the photosensitive member by means of anodizing or sand blasting, or to provide a light absorbing layer or an anti-reflective layer between the photosensitive layer and the substrate, but it has not been possible, in practice, to completely eliminate the interference fringe pattern appearing at the image formation. Particularly the surface graining method can hardly attain uniform coarseness and tends to form relatively large grains in a certain proportion, and such large grains function as charge injection areas into the photosensitive layer, giving rise to white dots in the image formation (or black dots if a reversal development is employed). Besides it is difficult, in the manufacture, to produce conductive substrates of uniform coarseness within the same production lot.

SUMMARY OF THE INVENTION

An object of the present invention is to provide a novel electrophotographic photosensitive member not associated with the aforementioned drawbacks and another object of the present invention is to provide an electrophotographic photosensitive member capable of completely preventing the interference fringe pattern appearing at the image formation and the black dots appearing at the reversal development.

According to one aspect of the present invention, there is provided an electrophotographic photosensitive member comprising a photosensitive layer on a conductive substrate having a smooth surface, wherein said photosensitive layer has a surface roughness, represented by an average roughness Rz of ten points over a reference length of 2.5 mm, is equal to or larger than $\frac{1}{2}$ of the wavelength of the light source employed for image formation.

According to another aspect of the present invention, there is provided an electrophotographic apparatus comprising:

an electrophotographic photosensitive member provided with a photosensitive layer on a conductive substrate of a smooth surface, wherein said photosensitive layer has a surface roughness, measured by an average roughness Rz of ten points over a reference length of 2.5 mm, not less than $\frac{1}{2}$ of the wavelength of the light source for image formation;

an electrostatic charging means;

an exposure means with a laser beam; and an image developing means.

According to a further aspect of the present invention, there is provided an electrophotographic photosensitive member comprising a photosensitive layer on a conductive substrate with a smooth surface, wherein said photosensitive layer has a surface roughness not less than 0.4 $\mu$m.

The foregoing objects can be achieved, according to the present invention, by an electrophotographic photosensitive member provided, on a conductive substrate of a smooth surface, with a photosensitive layer of a surface coarseness not less than $\frac{1}{2}$ of the wavelength of the light employed for image formation, when measured as an average coarseness Rz of ten points in a reference length of 2.5 mm, wherein said photosensitive member comprises a charge transport layer and a charge generation layer laminated thereon, wherein a charge generating material is included in said charge transport layer, and is adapted for use in an electrophotographic process utilizing a laser beam for image exposure.

DETAILED DESCRIPTION OF THE INVENTION

The electrophotographic photosensitive member of the present invention may be a photosensitive member with a single photosensitive layer (hereinafter called a single-layer photosensitive member), or a photosensitive member with a laminated structure composed of a charge generation layer and a charge transport layer, which is separated functionally (hereinafter called a laminate structure photosensitive member).

In the following a laminate structure photosensitive member is taken as an example of the present invention.

In a laminate structure photosensitive member, the interference fringe pattern formed electrophotographic image formation with a laser beam is caused by a change in the amount of incident light, caused by an interference due to a Fresnel reflection component, resulting from the difference in refractive indexes of the neighboring laminated layers.

Figure 2:
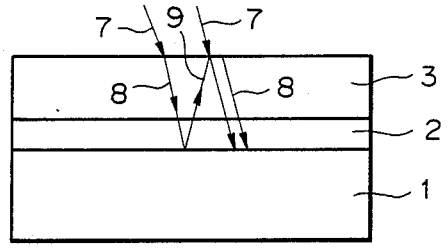
FIG. 2 is a schematic view showing the path of light entering a photosensitive member.

FIG. 2 shows the formation of an interference fringe pattern, in a laminate structure photosensitive member composed of a conductive substrate 1, a charge generation layer 2 and a charge transport layer 3, by a phase difference between a laser beam 7 and a reflected light 9 by an interface between the photosensitive layer and the substrate and by an interface between the photosensitive layer and air, after entering the photosensitive layer as indicated by 8.

Figure 3:
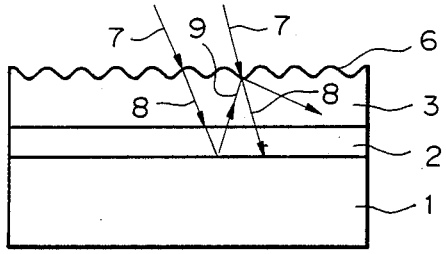
FIG. 3 is a schematic view showing the path of light in the structure of the present invention for avoiding the interference fringe pattern.

FIG. 3 illustrates the path of light in the structure of the present invention and the method of preventing the interference fringe pattern in the present invention.

The path of the entering light 8 of the laser beam 7 is deflected by an irregular surface 6, and the path of the light 9 reflected by the interface of the photosensitive layer and the substrate and by the interface of said photosensitive layer and the air is also deflected. The interference fringe pattern is no longer generated due to the difference in the directions of the entering light and the reflected light.

Figure 4:
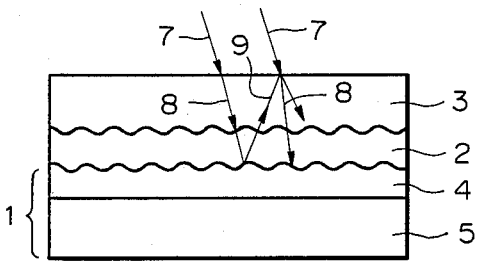
FIG. 4 is a schematic view showing the path of light in comparative Example 4 wherein the interference is prevented by the surface irregularity of the substrate of the photosensitive member.

FIG. 4 shows the path of light in a comparative Example 4 to be explained later, illustrating the mode of interference prevention by the surface irregularity of the substrate of the photosensitive member.

Basically, the interference component cannot be sufficiently removed if the optical phase difference inside the photosensitive member does not exceed $\frac{1}{2}$ of the wavelength of the laser beam. Consequently, for satisfactorily preventing the interference, the optical phase difference in the photosensitive member, or the phase difference formed at the interface, is preferably equal to or larger than $\frac{1}{2}$ of the wavelength $\lambda$ of the light source. The phase difference formed at the interface is slightly affected, to a certain extent, by the refractive indexes of the neighboring layers, but is principally determined by geometrical parameters, i.e. the coarseness of the interface.

Consequently, a phase difference, for example, equal to or larger than $\frac{1}{2}$ of the wavelength of the light source for image formation is enough for perfectly preventing the formation of interference fringe pattern.

The surface coarseness Rz employed in the present invention is an averaged coarseness of ten points over a reference length of 2.5 mm as defined in the Japan Industrial Standard JIS B0601-1982.

Effective prevention of interference is rendered possible under such condition, but electronic defects abnormally increase if the phase difference required for preventing the interference is obtained by rendering the surface of conductive substrate coarse. Thus the obtained image does not show interference fringe pattern but is inferior in quality with many white or black dots.

It is already known, for eliminating such electronic defects, to provide an insulating resin layer between the conductive substrate and the photosensitive layer, and, for this purpose there can be employed an intermediate resin barrier layer of a thickness of 0.1–5 μm composed for example of casein, polyvinyl alcohol, phenolic resin, chlorinated rubber, nitrocellulose resin, ethylene-acrylic acid copolymer, polyamide (nylon-6, nylon-66, nylon-610, nylon copolymer, alkoxymethylated nylon etc.), polyurethane or gelatin. However, when the surface of the conductive substrate is rendered coarse for preventing the interference, such resin layer cannot be made uniform and cannot satisfactorily perform the function of the barrier layer, so that the obtained image is of an insufficient quality.

In order to resolve the above-mentioned drawbacks, it is also proposed, instead of rendering the substrate and the interface coarse, to incorporate powdered material of a refractive index different from that of the charge transport layer, into said charge transport layer.

However the presence of such powdered material in the charge transport layer may induce a significant deterioration in the performance.

On the other hand the interference is prevented in the present invention by rendering the surface of the charge transport layer coarse, thus employing a conductive substrate of smooth surface and without incorporating the powder material in the charge transport layer.

Figure 1:
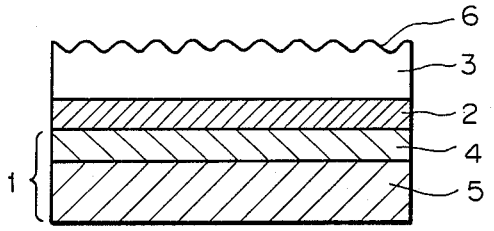
FIG. 1 is a cross-sectional view of an electro-photographic photosensitive member embodying the present invention.

The electrophotographic photosensitive member of the present invention may be a structure as shown in FIG. 1, wherein shown are a conductive substrate 1 composed of a conductive layer 4 and a substrate 5, a charge generation layer 2, and a charge transport layer 3 provided with a coarse surface 6.

The electrophotographic photosensitive member of the present invention can be effectively employed, for example, in an electrophotographic apparatus provided with electric charging means, exposure means and image development means The conductive substrate employed in the present invention can be composed of a metal cylinder such as aluminum, brass, copper, stainless steel and the like, or of a plastic film or a plastic cylinder such as polyester on which aluminum, tin oxide or indium oxide is deposited with a non-mirror surface. Furthermore, the substrate may be composed of a conductive or non-conductive film or cylinder of various materials on which a conductive layer is formed. Said conductive layer can be composed of an evaporated layer of a conductive metal such as aluminum, tin, gold and the like, or a coating layer in which conductive powder is dispersed. The conductive powder can be metal powder of aluminum, tin, silver or the like, or carbon powder, or conductive pigment principally composed of a metal oxide such as titanium oxide, barium sulfate, zinc oxide, tin oxide and the like.

For dispersing said conductive powder there may be employed any resin that shows (1) strong adhesion to the substrate,, (2) satisfactory dispersibility for the powder, and (3) sufficient solvent resistance, but particularly preferred is a thermosetting resin such as vulcanizable rubber, polyurethane, epoxy resin, alkyd resin, polyester, silicone resin, acryl-melamine resin and the like. The volume resistivity of the conductive layer of resin in which conductive pigment dispersed should not exceed $10^{13}\Omega$.cm, preferably $10^{12}\Omega$.cm. Consequently, the conductive pigment should be present in a proportion of 10–60 wt. % in the coated layer.

The conductive layer may further contain a surface energy reducing agent such as silicone oil, surfactant and the like in order to obtain an uniform coated film with reduced defects. The conductive powder can be dispersed in the resin with an ordinary method utilizing a roll mill, a ball mill, a vibrating ball mill, an attritor, a sand mill, a colloid mill and the like, and the mixture can be coated on a sheet-shaped substrate by wire bar coating, blade coating, knife coating, roller coating, screen coating or the like, or on a cylinder-shaped substrate by dip coating. The thickness of the conductive layer is generally in a range of 1–50 μm, preferably 5–30 μm.

In case of presence of a conductive layer on the substrate, said conductive layer is so formed as to have a smooth mirror surface.

In the present invention, there is eventually provided an intermediate layer having a barrier function and an adhesion function, between the conductive layer and the photosensitive layer.

Since the prevention of interference in the present invention is achieved by the surface, the presence of said intermediate layer does not affect the prevention of interference. Said intermediate layer can be composed, for example, of casein, polyvinyl alcohol, nitrocellulose, ethylene-acrylic acid copolymer, polyamide (nylon-6, nylon-66, nylon-610, nylon copolymer, alkoxymethylated nylon etc.), polyurethane, gelatin or aluminum oxide.

The thickness of said intermediate layer is generally in a range of 0.1–5 μm, preferably in a range of 0.3–2 μm.

The charge generation layer employed in the present invention is composed of a charge generating substance for example an azo pigment such as Sudan red, Dian blue or genus green B, a quinone pigment such as algol yellow, pyrenequinone or indanthrene brilliant violet RRB, a quinocyanine pigment, a pyrilene pigment, an indigo pigment such as indigo or thioindigo, a bisbenzoimidazole pigment such as indofast orange toner, a quinacridone pigment, an azulene compound disclosed in the Japanese Patent Application No. 165263/1982, a metal-free α, B, γ or χ-phthalocyanine, a complex salt of phthalocyanine containing a metal ion such as copper, silver, berylium, magnesium, calcium, zinc, cadmium, barium, mercury, aluminum, gallium, indium, lanthanum, neodymium, samarium, europium, gadolinium, dysprosium, holmium, erbium, thulium, ytterbium, lutetium, titanium, tin, hafnium, lead, thorium, vanadium, antimony, chromium, molybdenum, uranium, manganese, iron, cobalt, nickel, rhodium, paradium, osmium or platinum, or a phthalocyanine pigment in which the phthalocyanine radical of such phthalocyanine is halide or oxide, or a mixture thereof; and a binder resin such as polyester, polystyrene, polyvinyl butyral, polyvinyl pyrrolidone, methyl cellulose, polyacrylate ester or cellulose ester; both dispersed in an organic solvent for example an alcohol such as methanol or ethanol, a ketone such as methylethylketone or methylbutylketone, an ester such as methylethylester or methylbutylester, or cyclohexanone, or a mixture thereof. Said binder resin is preferably present in an amount of 20–300 parts by weight with respect to 100 parts by weight of the charge generating substance. The charge generating substance can be dispersed by an ordinary method utilizing a roll mill, a ball mill, a vibrating ball mill, an attritor , a sand mill, a colloid mill or the like. The average particle size of the charge generating substance after dispersion is preferably in a range of 0.01 to 1.0 μm in diameter. The obtained dispersion is coated by wire bar coating, blade coating, knife coating, roller coating, screen coating, spray coating, dip coating or the like, and the organic solvent is evaporated by an ordinary method such as heating to obtain a charge generation layer. The thickness thereof is preferably in a range of 0.01–1.0 μm. Said particle size can be measured for example with a centrifuging light-transmission particle size distribution meter CAPA-500 manufactured by Horiba Seisakusho Co.

The charge transport layer 3 is formed by dissolving a positive hole transporting substance, for example a compound containing, in the main or side chain thereof, a polycyclic aromatic compound such as anthracene, pyrene, phenanthrene or coronene, or a nitrogen-containing heterocyclic compound such as indol, carbazole, oxazole, isooxazole, thiazole, imidazole, pyrazole, oxadiazole, pyrrazoline, thiadiazole or triazole, or a hydrazone compound in a film-forming resin, because the charge transporting substance is generally of a low molecular weight and poor in film-forming property. Examples of such resin are polycarbonate, polymethacrylate esters, polyallylate, polystyrene, polyester, polysulfone, styrene-acrylonitrile copolymer and styrene-methyl methacrylate copolymer. The thickness of the charge transport layer 3 is in a range of 5–30 μm.

The aforementioned charge generation layer 2 may also be positioned on the charge transport layer 3 to constitute the photosensitive layer The surface coarseness in this case, when measured by the average coarseness $R_Z$ of ten points over a reference length of 2.5 mm, should not be less than ½ of the wavelength of the light source for image formation, as in the aforementioned case of the charge transport layer.

Also the photosensitive layer is not limited to those explained before but can be composed for example of a charge transfer complex of polyvinyl carbazole and trinitrofluorenone disclosed in the IBM Journal of the Research and Development, Jan. 1971, p. 75–89, or a pyrylium compound disclosed in the U.S. Pat. Nos. 4,315,983 and 4,327,169.

The surface coarseness of the charge transport layer can be controlled, for example in spray coating, by the liquid viscosity, solvent balance and spraying condition.

For example, if the viscosity and spraying condition are constant, the surface coarseness can be controlled by regulating the solvent balance.

A solvent composition which barely dissolves the underlying layer has a limited levelling effect, so that the coated surface becomes coarse.

On the other hand, a solvent composition easily dissolving the underlying layer provides a smooth coated surface due to the levelling effect.

Also even a solvent composition which little dissolves the underlying layer can provide a smooth coated surface by the levelling effect, if the solid content and viscosity are low.

The levelling effect also varies according to the distance of the spray gun and the drum. If the distance between the spray gun and the drum, the levelling is generally easy.

In this manner the surface coarseness is not determined uniquely but varies according to the materials and solvent, and the spraying condition.

Furthermore, the surface of the charge transport layer may be made coarse by suitable grinding means after said layer is formed.

Further, in the image formation, the laser beam as the light source for image exposure may have an oscillation wavelength, preferably, in range between 750 nm and 850 nm.

The present invention will be further clarified by following examples.

EXAMPLE 1

100 parts (hereinafter by weight) of conductive titanium oxide powder (manufactured by Titanium Kogyo Co., Ltd.), 100 parts of titanium oxide powder (Sakai L Kogyo Co., Ltd.) and 125 parts of a phenolic resin known under a trade name Plyophene (Dai-Nippon Ink Co., Ltd.) were mixed in a solvent of 50 parts of methanol and 50 parts of methyl cellosolve and dispersed for 6 hours in a ball mill. The obtained dispersion was dip coated on an aluminum cylinder of 60 mm in diameter and 260 mm in length, and was thermally set for 30 minutes at 150° C. to obtain a conductive layer of a thickness of 20 μm.

Then 10 parts of copolymerized nylon resin, known under a trade name Amilan CM8000 (Toray Co., Ltd.), was dissolved in a mixture of 60 parts of methanol and 40 parts of butanol and was dip coated on said conductive intermediate layer to obtain a polyamide resin layer of a thickness of 1 μm.

Subsequently 100 parts of ϵ-type copper phthalocyanine (Toyo Ink Co., Ltd.), 50 parts of butyral resin (Sekisui Chemical Co., Ltd.) and 1350 parts of cyclohexane were dispersed in a sand mill employing glass beads of 1 mm in diameter. The obtained dispersion was added with 2700 parts of methylethylketone, then dip coated on said polyamide resin layer, and dried for 10 minutes by heating at 50° C. to obtain a charge generation layer of a coating weight of 0.15 g/m$^2$.

Separately 10 parts of hydrazone compound of following structure:

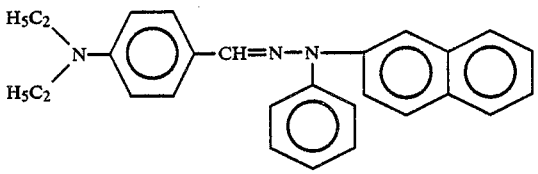

and 10 parts of polycarbonate resin (Mitsubishi Gas Chemical Company, Inc.) of a molecular weight of $2.5\times10^4$ with following molecular structure:

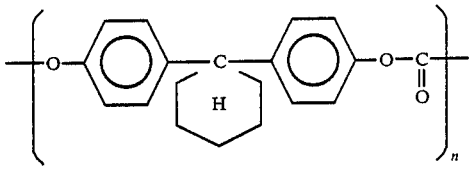

were dissolved in 90 parts of cyclohexanone and 140 parts of tetrahydrofurane. The obtained solution was spray coated under the following conditions on said charge generation layer, and dried for 90 minutes with hot air of 110° C. to obtain a charge transport layer of a thickness of 20 μm:

| | |
|---|---|
| Spray gun: | W-71-1G (Iwata Tosoki Kogyo Co.) |
| Drum-spray gun distance: | 250 mm |
| Spray air pressure: | 2.0 kg/cm$^2$ |
| Drum revolution: | 250 rpm |
| Gun discending speed: | 300 mm/min. |

The surface coarseness was measured by Universal Surface Tester manufactured by Kosaka Kenkyusho.

EXAMPLE 2

An electrophotographic photosensitive member was prepared by repeating the process of Example 1 except that cyclohexanone and tetrahydrofurane employed as the solvent for the charge transport layer were employed in respective amounts of 120 parts and 110 parts.

EXAMPLE 3

An electrophotographic photosensitive member was prepared by repeating the process of Example 1, except that the solvent for the charge transport layer was changed to 70 parts of cyclohexanone, 100 parts of tetrahydrofurane and 60 parts of monochlorobenzene.

EXAMPLE 4

An electrophotographic photosensitive member was prepared by repeating the process of Example 1, except that the solvent for the charge transport layer was changed to 70 parts of cyclohexanone, 70 parts of tetrahydrofurane and 90 parts of monochlorobenzene.

COMPARATIVE EXAMPLE 1

An electrophotographic photosensitive member was prepared by repeating the process of Example 1, except that the solvent for the charge transport layer was changed to 70 parts of cyclohexanone, 60 parts of tetrahydrofurane and 100 parts of monochlorobenzene.

COMPARATIVE EXAMPLE 2

An electrophotographic photosensitive member was prepared by repeating the process of Example 1 except that the solvent for the charge transport layer was changed to 60 parts of monochlorobenzene and that said layer was dip coated.

COMPARATIVE EXAMPLE 3

An electrophotographic photosensitive member was prepared by repeating the process of Example 1 except that the solvent for the charge transport layer was changed to 70 parts of cyclohexanone, 40 parts of tetrahydrofurane and 120 parts of monochlorobenzene.

EXAMPLE 5

The process was the same as in Example 1 up to the preparation of the intermediate layer.

Then 2 parts of ϵ-type copper phthalocyanine (Toyo Ink Co., Ltd.) was added to 10 parts of the aforementioned polycarbonate resin dissolved in 90 parts of cyclohexanone, and the mixture was dispersed for 20 hours in a sand mill employing glass beads of 1 mm in diameter. Then 10 parts of the same hydrazone compound as that employed in Example 1 were dissolved therein.

The obtained liquid was spray coated on the intermediate layer and dried for 90 minutes with hot air of 110° C. to obtain a photosensitive layer of a thickness of 20 μm, thereby preparing an electrophotographic photosensitive member.

EXAMPLE 6

The process was the same as in Example 1 up to the preparation of the intermediate layer.

Subsequently 10 parts of the hydrazone compound and 10 parts of the polycarbonate resin, employed in Example 1, were dissolved in 60 parts of monochlorobenzene. The obtained solution was dip coated on said intermediate layer, and dried for 60 minutes with hot air of 100° C. to obtain a charge transport layer of a thickness of 20 μm.

Then 1 part of ϵ-type copper phthalocyanine (Toyo Ink Co., Ltd.), 10 parts of the aforementioned polycarbonate resin and 100 parts of cyclohexanone were dispersed for 20 hours in a sand mill employing glass beads of 1 mm in diameter. In the obtained dispersion there was dissolved 10 parts of the aforementioned hydrazone compound.

Coating liquid was obtained by further adding 150 parts of cyclohexanone to said dispersion.

Said coating liquid was spray coated on said charge transport layer under same conditions as in Example 1 except that the gun descending speed was changed to 1200 mm/min, and dried for 90 minutes with hot air of 110° C. to obtain a charge transport layer of a thickness of 5 μm. An electrophotographic photosensitive member was thus completed.

COMPARATIVE EXAMPLE 4

An electrophotographic photosensitive member was prepared in the same manner as in Comparative Example 2, except that 10 parts of butyral resin known under a trade name BM-2 (Sekisui Chemical Co., Ltd.) were added to the conductive paint in Example 1.

EXAMPLE 7

An electrophotograpahic photosensitive member was prepared by repeating the process of Example 1, except that the charge transport layer coating was prepared with a single solvent consisting of 230 parts of tetrahydrofurane and was dip coated instead of spray coating. The charge transport layer was found to have a coarse surface due to the blushing phenomenon under visual observation.

COMPARATIVE EXAMPLE 5

An electrophotographic photosensitive member was prepared by repeating the process of Example 7, except that the solvent for the charge transport layer was changed to 100 parts of tetrahydrofurane and 130 parts of monochlorobenzene. The charge transport layer was different from that in Example 7 with no blushing phenomenon occurred and showed a smooth surface.

COMPARATIVE EXAMPLE 6

An electrophotographic photosensitive member was prepared in the same manner as in Comparative Example 5, except that an aluminum cylinder of 60 mm in diameter and 260 mm in length, having a surface roughness of 2.0 μm to which no mirror surface treatment was applied was used as the substrate and that no conductive layer as in Comparative Example 5 was formed.

The electrophotographic photosensitive members prepared in the foregoing examples and comparative examples were subjected to the measurement of surface coarseness and to the evaluation on an electrophotographic printer, Canon Laser Beam Printer LBP-CX (Canon K.K.) provided with a semiconductor layer of a wavelength of 778 nm and employing reversal development. The results are summarized in the following, wherein:

Interference fringe
+No interference fringe
±Slight interference fringe
−Evident interference fringe
Image defect (in an A4-sized solid white image):
+three black dots or less
±Four to nine black dots
−Ten black dots or more

| | Surface roughness (μm) | Interference fringe | Image defects (black dot) Initial | After Continuous 10,000 copies |
|---|---|---|---|---|
| Example 1 | 1.5 | + | + | + |
| Example 2 | 0.9 | + | + | + |
| Example 3 | 1.0 | + | + | + |
| Example 4 | 0.4 | + | + | + |
| Compar. Ex. 1 | 0.3 | −~± | + | + |
| Compar. Ex. 2 | 0 | − | + | + |
| Compar. Ex. 3 | 0.2 | − | + | + |
| Example 5 | 1.2 | + | + | + |
| Example 6 | 0.8 | + | + | + |
| Compar. Ex. 4 | 0* | + | + | − |
| Example 7 | 0.7 | + | + | + |
| Compar. Ex. 5 | 0.1 | − | + | + |
| Compar. Ex. 6 | 0.2 | + | + | − |

*The conductive layer showed a surface roughness of 1.5 μm due to the addition of butyral resin.

What is claimed is:

1. An electrophotographic photosensitive member comprising a photosensitive layer on a conductive substrate having a smooth surface, wherein said photosensitive layer has a surface roughness, represented by an average roughness Rz of ten points over a reference length of 2.5 mm, is equal to or larger than ½ of the wavelength of the light source employed for image formation.

2. An electrophotographic photosensitive member according to claim 1, comprising a charge generation layer and a charge transport layer laminated on said charge generation layer.

3. An electrophotographic photosensitive member according to claim 1, comprising a charge transport layer and a charge generation layer laminated on said charge transport layer.

4. An electrophotographic photosensitive member according to claim 1, comprising a charge generating material in a charge transport layer.

5. An electrophotographic photosensitive member according to claim 1, wherein the photosensitive layer is formed by spray coating.

6. An electrophotographic photosensitive member according to claim 1, wherein the surface roughness of said photosensitive layer is not more than 1.5 μm.

7. An electrophotographic apparatus according to claim 1, wherein the surface roughness of said photosensitive layer is not more than 1.5 μm.

8. An electrophotographic apparatus according to claim 1, wherein the photosensitive layer is formed by spray coating.

* * * * *

UNITED STATES PATENT AND TRADEMARK OFFICE

CERTIFICATE OF CORRECTION

PATENT NO. : 4,904,557

DATED : February 27, 1990

INVENTOR(S) : KEIJI KUBO

It is certified that error appears in the above-identified patent and that said Letters Patent is hereby corrected as shown below:

COLUMN 1

Line 14, "such" should read --to a--.

COLUMN 2

Line 13, "drawbacks" should read --drawbacks,--.

COLUMN 3

Line 22, "formed" should read --formed during--.

COLUMN 5

Line 7, "dispersed" should read --is dispersed--.
Line 13, "an" should read --a--.

COLUMN 7

Line 3, "drum, the" should read --drum is proper, the--.
Line 15, "in range" should read --in the range--.
Line 24, "L" should be deleted.

COLUMN 8

Line 22, "Gun discending speed: 300 mm/min." should read --Gun descending speed: 300 mm/min.--.

COLUMN 9

Line 34, "was" should read --were--.

UNITED STATES PATENT AND TRADEMARK OFFICE

CERTIFICATE OF CORRECTION

PATENT NO. : 4,904,557

DATED : February 27, 1990

INVENTOR(S) : KEIJI KUBO

It is certified that error appears in the above-identified patent and that said Letters Patent is hereby corrected as shown below:

COLUMN 10

Line 2, "occurred" should read --occurring--.
Line 21, "Interference fringe" should read --Interference fringe:--.
Line 55, "mm, is equal" should read --mm, which is equal--.

COLUMN 11

Line 7, "apparatus" should read --photosensitive member--.

COLUMN 12

Line 2, "more than 1.5 μm" should read --less than 0.4 μm--.
Lines 3-5, delete claim 8.

Signed and Sealed this

Ninth Day of July, 1991

*Attest:*

*Attesting Officer*

HARRY F. MANBECK, JR.

*Commissioner of Patents and Trademarks*